United States Patent [19]

Bamburg et al.

[11] 3,957,179

[45] *May 18, 1976

[54] BULK MATERIAL CONTAINER WITH POURING SPOUT

[75] Inventors: Robert A. Bamburg; Farris N. Duncan, both of West Monroe; Roger M. Floyd, Monroe, all of La.

[73] Assignee: Olinkraft, Inc., West Monroe, La.

[ * ] Notice: The portion of the term of this patent subsequent to Feb. 12, 1991, has been disclaimed.

[22] Filed: July 12, 1974

[21] Appl. No.: 488,085

Related U.S. Application Data

[63] Continuation-in-part of Ser. No. 432,946, Jan. 14, 1974, abandoned, which is a continuation-in-part of Ser. No. 288,899, Sept. 14, 1972, Pat. No. 3,791,562.

[52] U.S. Cl. ..... 222/528; 222/529; 222/536; 229/7 SC

[51] Int. Cl.[2] ..... B67D 3/00

[58] Field of Search ..... 229/4.5, 5.7, 7 R, 7 SC, 229/14 BW, 14 BA, 17 R, 17 B, 17 M, 17 SC, 23 BT, 41 C; 222/181, 182, 462, 526, 527, 528, 529, 537, 572, 573, 574; 221/305

[56] References Cited

UNITED STATES PATENTS

| | | | |
|---|---|---|---|
| 2,349,748 | 5/1944 | Otto | 229/17 |
| 2,799,440 | 7/1957 | Frederich et al. | 229/17 |
| 3,010,633 | 11/1961 | Reher | 229/23 BT X |
| 3,014,637 | 12/1961 | Wilson | 229/41 C |
| 3,193,152 | 7/1965 | White | 222/182 |
| 3,599,830 | 8/1971 | Gilchrist | 221/305 |
| 3,791,562 | 2/1974 | Bamburg et al. | 222/528 |

*Primary Examiner*—Allen N. Knowles
*Attorney, Agent, or Firm*—O'Brien & Marks

[57] ABSTRACT

A bulk material container has a recloseable pouring spout formed in the bottom portion of the side of the container. The pouring spout is formed by a door cut in a juxtaposed side panel and band of the container. A valve member is slidable between the side panel and the band for closing the pouring spout. The container is particularly provided with a liner telescoped in the carton and having an opening aligned with the pouring spout.

7 Claims, 12 Drawing Figures

BULK MATERIAL CONTAINER WITH POURING SPOUT

CROSS REFERENCE TO RELATED APPLICATION

This application is a continuation-in-part of our United States patent application Ser. No. 432,946 filed Jan. 14, 1974, now abandoned, which was a continuation-in-part of our United States patent application Ser. No. 288,899 , filed Sept. 14, 1972, now U. S. pat. No. 3,791,562. Said U.S. pat. No. 3,791,562 and United States patent application Ser. No. 432,946 are herein incorporated by reference.

BACKGROUND OF THE INVENTION

1. Field of the Invention:

This invention relates to containers for shipping and storing bulk material, and particularly, to paperboard containers having pouring spouts for dispensing bulk material. Such containers have particular utility for handling, storing and dispensing relatively large quantities of bulk materials, such as rice, other grains, carbon black, other chemicals, and the like.

2. Description of the Prior Art:

The prior art, as exemplified in U. S. Pat Nos. 1,020,536; 1,842,237; 2,151,202; 2,349,748; 2,357,092; 2,781,156; and 3,082,926, contains a number of containers having recloseable openings or pouring spouts located adjacent or on the top of the container. Such containers require tipping or inverting in order to dispense the contents through the opening or pouring spout. Top pouring spouts on containers have been satisfactory for small containers of the type which are easily held in the user's hands; however, for containers storing large quantities of bulk material where the weight of the material renders lifting and inversion of the container impractical, such top pouring spouts have not been satisfactory.

Additionally, the prior art, as illustrated in U.S. Pat. Nos. 1,959,231; 2,585,056; 2,799,440; 3,012,044; 3,066,842; 3,193,152; 3,599,830; 3,606,969, and 3,701,466, contains a mumber of containers with facilities for dispensing the contents from the bottom of the containers. The prior art bottom dispensing facilities generally are not capable of positively controlling the flow of material from the container and are generally not easily closeable against the pressure of the remaining contents within the container.

Bulk material containers in the prior art, particularly when used for a relatively heavy material such as rice, have been subject to puncture or bulging of the side wall. Also, when stacked in a warehouse or the like, the containers on the bottom of the stack are susceptable to being crushed by the weight of the containers and material on top. Manufacturer's joints, particularly single overlapping side wall joints, can break open when full containers are lifted, moved, or set down in normal handling conditions. Where encircling steel straps are employed to reinforce the side walls of the containers, the straps and their clasps can catch on other objects or can have sharp exposed edges and points which can be hazardous to people handling the containers.

SUMMARY OF THE INVENTION

The invention is summarized in that a bulk material container includes an enclosed vertical outer wall, a bottom, a band encircling a bottom portion of the outer wall, a closeable pouring spout formed in the band and the bottom portion of the outer wall including door means formed in the outer wall and band to swing outwardly and define an opening in the container for the pouring spout to dispense contents from the container; a valve member slidable between the outer wall and the band to be movable into the opening to stop the dispensing of the contents from the container, and a liner telescoped in the outer wall and having an opening aligned with the opening in the container.

Accordingly, it is an object of the invention to construct a bulk material container which may be used as a shipping container, a storage container and a dispensing container with facilities for dispensing the contents of the container being formed integral with the container and being easily opened and closed by the user.

Another object of the invention, is to provide a bulk material container having a pouring spout and which has substantially improved structure resisting puncture, bulging or crushing.

It is also in object of the invention to provide a bulk material container with reinforcing straps not exposed to other objects and personnel.

Some of the advantages of the present invention over the prior art are that the flow of contents through a pouring spout is positively controlled by a pouring spout and valve member structure which is simple in nature, a valve member is held in position by juxtaposed wall members to prevent bending or other deformation of the valve member by the force of the contents being dispensed, a liner substantially increases the strength of the walls of the container, a double manufacturer's joint resists breakage of the joint, and reinforcing straps are sandwiched between the outer side walls and the liner to avoid snagging and danger to other objects and personnel.

Other objects and advantages of the present invention will become apparent from the following description of the preferred embodiment taken in conjunction with the accompanying drawings.

DESCRIPTION OF THE PREFERRED EMBODIMENTS

Figure 1:
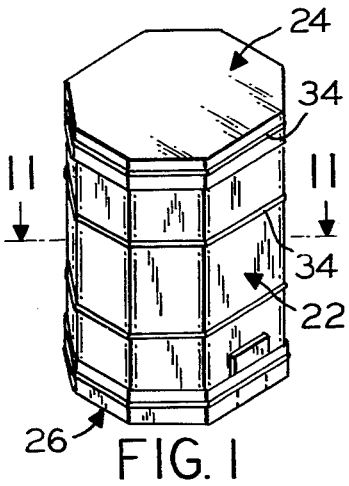
FIG. 1 is a prospective view of a bulk material container in accordance with the invention.

As illustrated in FIG. 1, the invention is embodied in a bulk material container, including an elongated open-ended and vertically extending hollow body indicated generally at 22, a top lid indicated generally at 24, and a bottom lid indicated generally at 26. The body 22 has a horizontal cross section which is polygonal such as the illustrated octagonal shape. The bottom lid 26 has a matching polygonal center section 28, FIG. 4, covering the open bottom end of the body 22. A plurality flaps 30, each integrally formed on a respective side edge of the section 28, extend upward over the outside of a bottom portion of the body 22 and are suitably attached thereto. A band 32 circumscribes the flaps 30 and the bottom portion of the body 22. Additional reinforcing means such as steel straps or reinforced tapes 34, circumscribe the body 22, downward extending side portions as the top lid 24, and the band 32 of the bottom lid 26. A more detailed description of the top lid 24, the bottom lid 26 and the reinforcing means 34 is contained in our aforementioned U.S. Pat. No. 3,791,562 and U.S. patent application Ser. No. 432,946.

Figure 10:
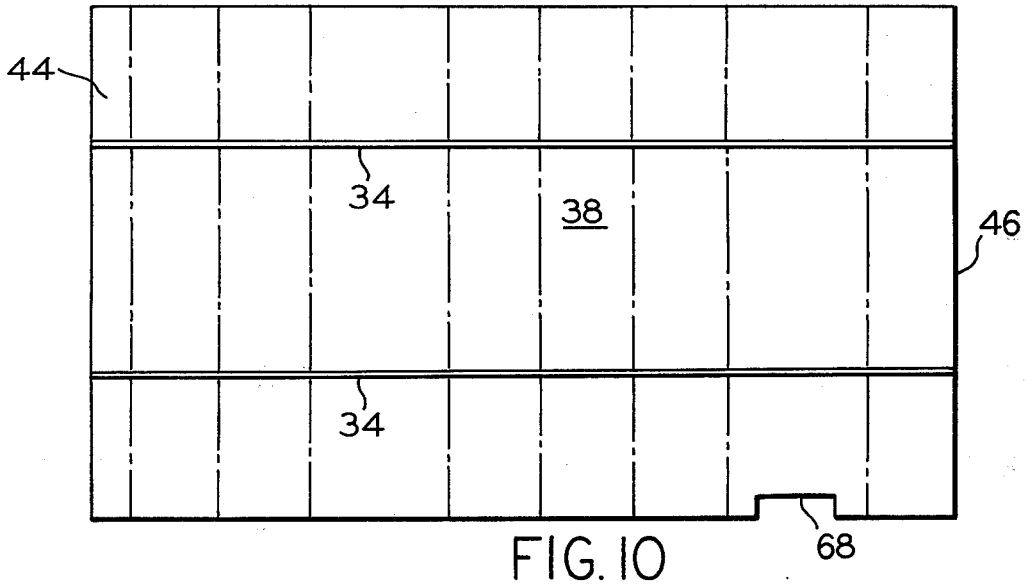
FIG. 10 is a plan view of a blank used to form a liner for the container of FIG. 1.
Figure 11:
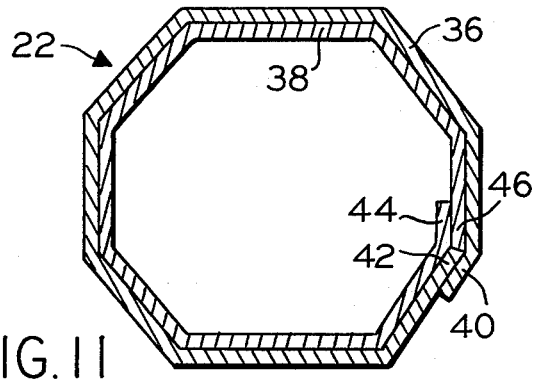
FIG. 11 is a cross section view taken along a horizontal plane containing line 11—11 of FIG. 1.

As shown in FIG. 11, the body 22 includes an enclosed vertical outer wall 36 and an enclosed vertical liner or inner vertical enclosed wall 38. The outer wall 36 is formed from a blank, shown in FIG. 9, which has eight serially hinged panels with a manufacturer's joint flap 40 integrally formed at one end of the outer wall blank for overlapping the panel at the other end 42 of the outer wall blank. The liner 38 is formed from a blank illustrated in FIG. 10, which has eight serially hinged panels and a manufacturer's joint flap 44 integrally formed at one end of the liner blank for overlapping the panel at the other end 46 of the liner blank. The outer wall 36 and the liner 38 have substantially identical vertical dimensions. The horizontal lengths of the panels of the liner 38 are slightly less than the horizontal lengths of the corresponding panels of the outer wall 36 so that the liner 38 is telescoped within the outer wall 36. When assembled, the end 42 of the outer wall 36 abuts the end 46 of the liner 38, and the flaps 40 and 44 extend in opposite directions over the abutting ends outside and inside, respectively, of the body 22 to form a double manufacturer's joint. It is preferred that a suitable adhesive securely bond substantially the entire juxtaposed surfaces of the outer wall 36 and liner 38 including the flaps 40 and 44, however the flaps 40 and 44 may be secured to the respective overlapped panel portions by any suitable means with the liner 38 not bonded to the outer wall 36.

Figure 9:
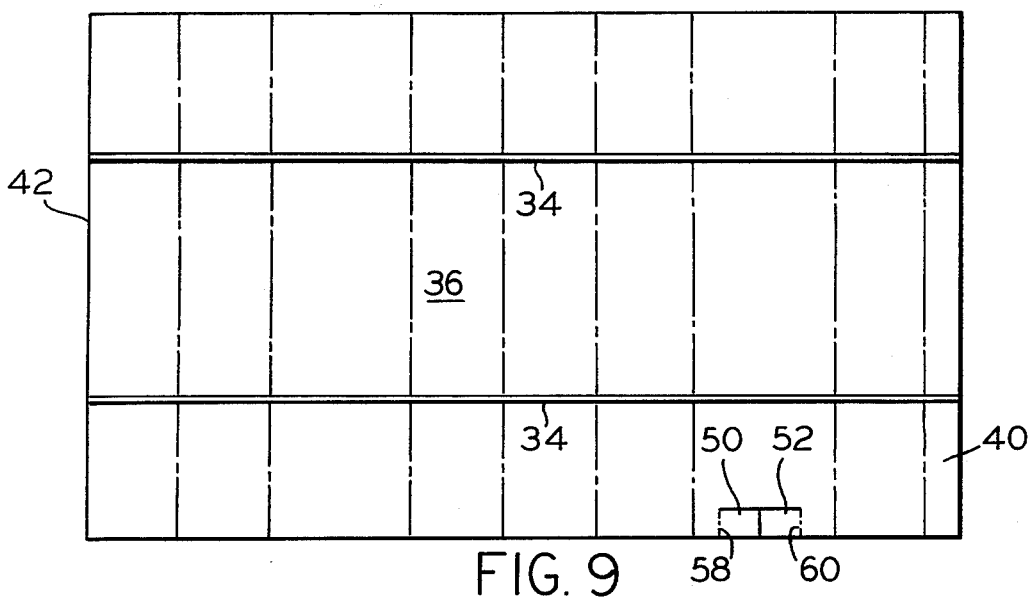
FIG. 9 is a plan view of a blank used to form an outer wall of the container of FIG. 1.

The reinforcing means, as illustrated in FIGS. 9 and 10 may be reinforcing straps attached to or laminated in the blanks for both the outer wall 36 and liner 38.

Figure 2:
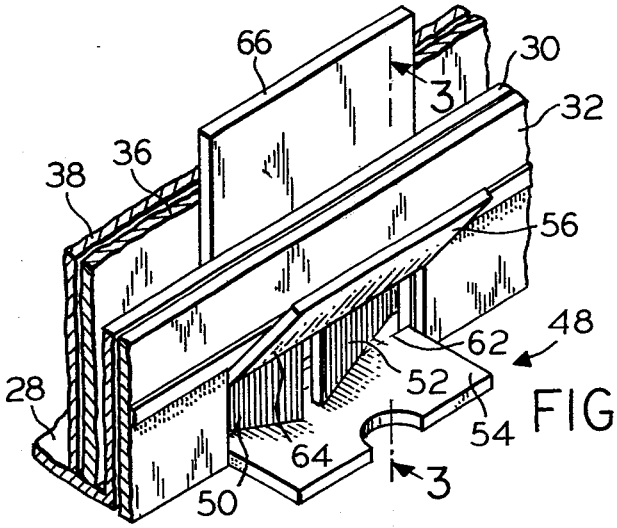
FIG. 2 is a prospective view of a broken away portion of the bulk material container of FIG. 1.

A recloseable pouring spout, indicated generally at 48 in FIG. 2, is formed in the bottom of the side of the container by a pair of inner doors 50 and 52, an intermediate door 54 and an outer door 56. The inner doors 50 and 52 are cut in the bottom portion of one panel of the outer wall 36 and are swingable outwardly about respective parallel vertical axes 58 and 60, FIG. 9, formed by respective score lines. The intermediate door 54 is cut from the flap 30 and is swingable outwardly and downwardly about a horizontal axis 62, formed by a suitable score line. The outer door 56 is cut in the band 32 to be swingable outwardly and upwardly about a horizontal axis 64 formed by a similar score line. A flat valve member 66 is vertically slidable between the juxtaposed surfaces of the outer wall 36 and the flap 30 for entering an opening of the pouring spout 48, formed by the inner doors 50 and 52, intermediate door 54 and outer door 56. More specific details of the recloseable pouring spout are described in our aforementioned U. S. Pat. No. 3,791,562 and U.S. patent application Ser. No. 432,946, now abandoned.

As shown in FIGS. 4, 6, 8 and 10 the liner 38 is formed with an opening 68, which is aligned with the opening of the recloseable pouring spout formed by the doors 50 and 52, so that the contents in the interior of the container may freely pass therethrough.

In use, the container maybe filled with a bulk material, such as rice or the like, when the top lid 24 is removed. Thereafter the container may be used for shipping, storage and dispensing the bulk material.

Figure 3:
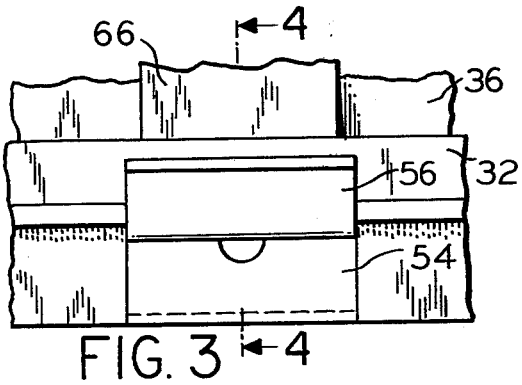
FIG. 3 is an elevation view taken as indicated by the arrows 3—3 in FIG. 2 after a first step in forming a pouring spout for the container.
Figure 4:
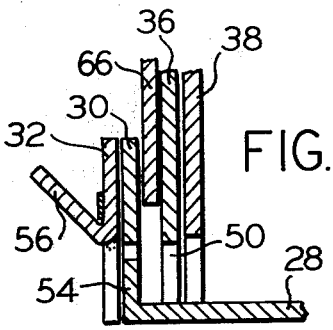
FIG. 4 is a cross section view taken along line 4—4 of line 3.
Figure 5:
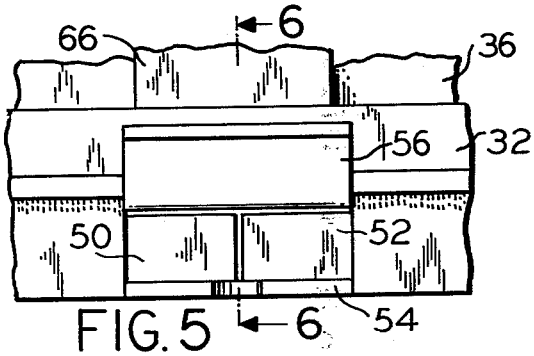
FIG. 5 is a view similar to FIG. 3 after a later step in forming a pouring spout.
Figure 6:
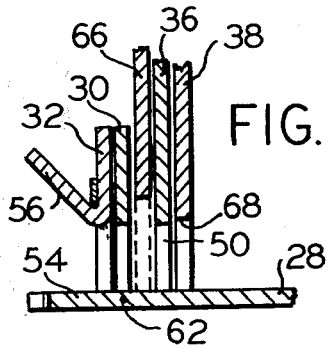
FIG. 6 is a cross section view taken along line 6—6 of FIG. 5.
Figure 7:
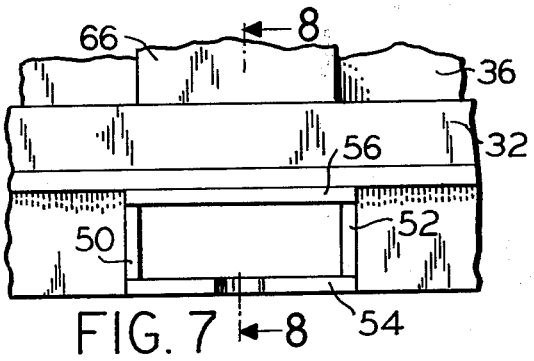
FIG. 7 is a view similar to FIGS. 3 and 5 after a pouring spout has been formed.
Figure 8:
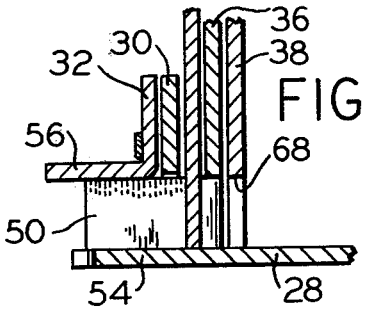
FIG. 8 is a cross section view taken along line 8—8 of FIG. 7.

When it is desired to dispense the bulk material of the container, the upward swinging door 56 is cut along a perforated line provided in the band 32 and the door 56 opened, as shown in FIGS. 3 and 4. Then the preformed door 54 is swung downwardly as illustrated in FIGS. 5 and 6 about its axis 62 to expose the inner doors 50 and 52. The inner doors 50 and 52 are swung sideways, FIGS. 7 and 8, between the doors 54 and 56 to maintain the doors 54 and 56 separated. The resiliency of the material forming the doors 54 and 56 causes the doors 54 and 56 to grip the doors 50 and 52 to retain the doors 50 and 52 in their open position. During the dispensing of material from the container the sliding valve member 66 may be pushed down to partially close the opening formed through the doors in order to positively control the flow of material from the container. After the desired quantity of material has been dispensed, the slide valve may be pushed down to close the opening, thus stopping the flow of material from the container.

The liner 38 for the container particularly reinforces the outer wall 36 so that it may better withstand the pressures exerted within the container by the bulk material. Additionally the liner 38 substantially reinforces the walls of the container so that additional containers without be stacked on top thereof for storage and shipment witout crushing the bottom containers.

Figure 12:
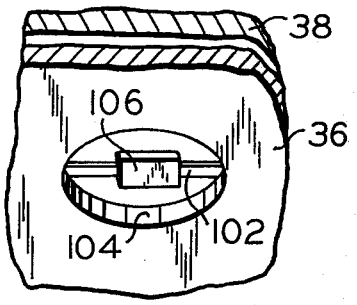
FIG. 12 is a perspective view of a broken-away portion from a modified bulk material container.

A modification of the bulk material container of FIG. 1 is illustrated in FIG. 12 wherein a steel strap 102 circumscribes the liner 38 and is sandwiched between the outer wall 36 and the liner 38. The outer wall 36 has an opening 104 formed therein exposing the ends of the strap 102 so that a clasp or clamp 106 can be applied to secure the ends of the strap 102 together and form a reinforcing band. The thickness of the outer wall 36 is sufficient to result in the clasp 106 being recessed from the outer surface of the wall. Sandwiching the steel strap between the liner 36 and the outer wall 38 together with recessing the clasp 106 substantially eliminates any hazard created by sharp exposed edges and points of reinforcing bands as well as preventing snagging of the reinforcing bands.

Since may variations, modifications and changes in detail may be made to the above described embodiments, it is intended that all matter described in the foregoing description or shown in the accompanying drawings be interpreted as illustrative and not in a limiting sense.

What is claimed is:

1. A bulk material container comprising
an enclosed vertical outer wall,
a bottom,
a band encircling a bottom portion of the outer wall,
a recloseable pouring spout including a pair of opposite first doors formed in the outer wall and hinged at respective vertical score lines to swing outwardly in opposite directions about the vertical score lines to form an opening in the outer wall between the score lines, said recloseable pouring spout also including a second door formed in the band and hinged at a horizontal score line to swing outwardly about the horizontal score line, said first doors having a size designed to swing through the opening formed in the band by the second door and to maintain the second door swung outward, said first and second doors defining an opening in the container for said pouring spout to dispense contents from the container,
a valve member vertically slidable between the outer wall and the band and having a size designed to be movable into said opening in the container between the pair of first doors when the first doors are open to stop the dispensing of contents from said container, and
a liner telescoped in the outer wall and having an opening aligned with the opening in the container.

2. A bulk material container as claimed in claim 1 including a reinforcing strap circumscribing the liner and sandwiched between the liner and the outer wall.

3. A bulk material container comprising
an enclosed vertical outer wall,
a bottom,
a band encircling a bottom portion of the outer wall,
a recloseable pouring spout including door means formed in the outer wall and band to swing outwardly and define an opening in the container for said pouring spout to dispense contents from the container,
a valve member slidable between the outer wall and the band to be movable into said opening to stop the dispensing of contents from said container,
a liner telescoped in the outer wall and having an opening aligned with the opening in the container,
a steel reinforcing strap circumscribing the liner and sandwiched between the liner and the outer wall,
the outer wall having an opening exposing opposite ends of the steel strap, and means recessed in the opening of the outer wall for securing together the ends of the steel strap.

4. A bulk material container comprising a bottom; an inner vertical enclosed wall; an outer vertical enclosed wall telescoped over said inner wall; said bottom having a plurality of flaps extending upward over a lower portion of said inner and outer walls; an outer band encircling said plurality of flaps; and a top; said container having a threepart pouring spout including
an upwardly swinging door formed in said outer band of the container,
a downwardly swinging door formed in one of said plurality of flaps of the bottom of the container for facing said upwardly swinging door,
at least one sidewardly swinging door formed in said outer wall of the container between said upwardly and downwardly swinging door,
said doors being formed and positioned so that said sidewardly swinging door swings about an axis transverse to the axes of said upwardly and downwardly swinging doors to retain said upwardly and downwardly swinging doors in a generally horizontal position thereby allowing the contents of the container to be removed, and
said inner wall having an opening aligned with the sidewardly swinging door.

5. The pouring spout as claimed in claim 4 further comprising a slide valve movable to be positioned between said doors for cutting off the flow of the contents thereby allowing said doors to be rapidly closed without the contents of the container exerting an undue pressure on the pouring spout.

6. A bulk material container as claimed in claim 4 wherein said inner wall includes a plurality of serially hinged panels with an inner manufacturer's joint flap on one end of the inner wall panels overlapping and secured to the other end of the inner wall panels, said outer wall includes a plurality of serially hinged panels with an outer manufacturer's joint flap on one end of the outer wall panels overlapping and secured to the other end of the outer wall panels.

7. A bulk material container as claimed in claim 4 where said other end of the inner panels and said other end of the outer panels abut, and said inner and outer manufacturer's joint flaps extend in opposite directions over said abutting other ends.

* * * * *

UNITED STATES PATENT OFFICE

CERTIFICATE OF CORRECTION

PATENT NO. : 3,957,179

DATED : May 18, 1976

INVENTOR(S) : Robert A. Bamburg, Farris N. Duncan, Roger M. Floyd

It is certified that error appears in the above-identified patent and that said Letters Patent are hereby corrected as shown below:

Column 4, Line 45, delete "without" and insert in place thereof -- may -- .

Signed and Sealed this

Ninth Day of November 1976

[SEAL]

*Attest:*

RUTH C. MASON
*Attesting Officer*

C. MARSHALL DANN
*Commissioner of Patents and Trademarks*